US008578866B2

(12) United States Patent
Lüling

(10) Patent No.: US 8,578,866 B2
(45) Date of Patent: Nov. 12, 2013

(54) CONTAINER FOR STORING OBJECTS, AND AN ABSORBER ELEMENT FOR SUCH A CONTAINER

(75) Inventor: Harald Lüling, Meinerzhagen (DE)

(73) Assignee: Burg-Wächter KG, Meinerzhagen (DE)

( * ) Notice: Subject to any disclaimer, the term of this patent is extended or adjusted under 35 U.S.C. 154(b) by 940 days.

(21) Appl. No.: 12/531,854

(22) PCT Filed: Mar. 14, 2008

(86) PCT No.: PCT/EP2008/002070
§ 371 (c)(1),
(2), (4) Date: Dec. 2, 2009

(87) PCT Pub. No.: WO2008/113526
PCT Pub. Date: Sep. 25, 2008

(65) Prior Publication Data

US 2010/0064949 A1 Mar. 18, 2010

(30) Foreign Application Priority Data

Mar. 17, 2007 (DE) ..... 20 2007 003 938 U
Jan. 18, 2008 (DE) ..... 20 2008 000 808 U

(51) Int. Cl.
*E06B 9/00* (2006.01)

(52) U.S. Cl.
USPC ..... 109/49.5; 109/76; 109/80; 109/82; 428/317.1; 428/138

(58) Field of Classification Search
USPC ..... 109/49.5, 76, 78, 80, 82–85; 428/317.1, 428/317.9, 138
See application file for complete search history.

(56) References Cited

U.S. PATENT DOCUMENTS 3,567,536 A * 3/1971 Wickersham ..... 156/78
3,739,731 A * 6/1973 Tabor ..... 109/49.5
(Continued)

FOREIGN PATENT DOCUMENTS

DE 20 2006 004439 U1 5/2006
DE 10 2005 041943 A1 3/2007
(Continued)

OTHER PUBLICATIONS

Translation of International Preliminary Report on Patentability for PCT/EP2008/002070 (Mar. 14, 2008).

*Primary Examiner* — Suzanne Barrett
(74) *Attorney, Agent, or Firm* — Harness, Dickey & Pierce, P.L.C.

(57) ABSTRACT

The invention relates to a container for storing objects to be protected from unauthorized access, particularly an automatic teller, vault (1), safe or security cabinet, comprising a housing (2) having a storage space, the housing having a rear wall, two side walls (3) disposed opposite each other, a base (4) and a top (5), wherein the base (4) and the top (5) are disposed opposite each other and connect the side walls (3) to each other, wherein the housing (2) has at least one opening (6) that can be locked using a door (7) and/or flap. In order to improve a generic container such that it is sufficiently protected from unauthorized opening by explosion, while simultaneously being constructed in a simple manner, so that a corresponding container can also be produced in a cost-effective manner, the invention provides that an absorber element (10) is disposed in the storage space.

34 Claims, 5 Drawing Sheets

(56) References Cited

U.S. PATENT DOCUMENTS

Figure 3:
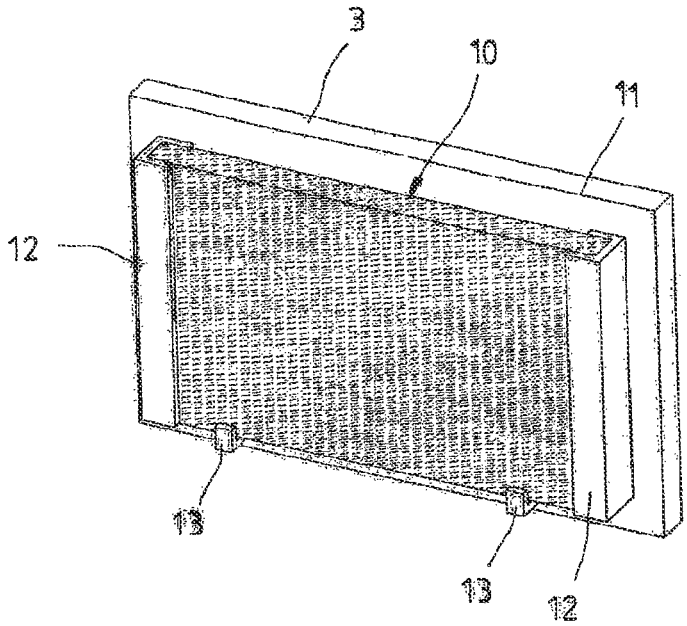

| | | | | | |
|---|---|---|---|---|---|
| 3,762,787 | A | * | 10/1973 | Grubb | 312/409 |
| 4,198,454 | A | * | 4/1980 | Norton | 428/117 |
| 4,263,365 | A | * | 4/1981 | Burgess et al. | 428/312.4 |
| 4,373,450 | A | | 2/1983 | Miller et al. | |
| 4,489,663 | A | | 12/1984 | Poag et al. | |
| 4,889,258 | A | * | 12/1989 | Yerushalmi | 220/560.01 |
| 5,267,665 | A | * | 12/1993 | Sanai et al. | 220/88.1 |
| 5,390,580 | A | * | 2/1995 | Gibbons et al. | 86/50 |
| 5,645,184 | A | * | 7/1997 | Rowse et al. | 220/1.5 |
| 5,990,377 | A | * | 11/1999 | Chen et al. | 604/381 |
| 6,019,237 | A | * | 2/2000 | Durham et al. | 220/1.6 |
| 6,177,368 | B1 | * | 1/2001 | Fisher | 442/221 |
| 6,196,107 | B1 | * | 3/2001 | Hoffman et al. | 86/50 |
| 6,702,230 | B2 | * | 3/2004 | Movsesian et al. | 244/118.5 |
| 6,749,076 | B2 | * | 6/2004 | Fingerhut et al. | 220/1.5 |
| 7,208,222 | B2 | * | 4/2007 | Rolfe et al. | 428/304.4 |
| 7,415,806 | B2 | * | 8/2008 | Davidson | 52/426 |
| 7,482,928 | B2 | * | 1/2009 | Brackmann et al. | 340/572.1 |
| 7,866,248 | B2 | * | 1/2011 | Moore et al. | 89/36.02 |
| 7,895,798 | B2 | * | 3/2011 | Guirgis | 52/202 |
| 7,926,407 | B1 | * | 4/2011 | Hallissy et al. | 89/36.02 |
| 8,245,619 | B2 | * | 8/2012 | Hall | 89/36.02 |
| 2007/0222116 | A1 | * | 9/2007 | Gould et al. | 264/321 |
| 2009/0142557 | A1 | * | 6/2009 | Hardin | 428/198 |
| 2010/0012004 | A1 | * | 1/2010 | Telander | 109/49.5 |

FOREIGN PATENT DOCUMENTS

| | | | | |
|---|---|---|---|---|
| EP | 0 269 357 | A2 | | 6/1988 |
| GB | 2149482 | A | * | 6/1985 |
| WO | WO-97/16697 | A1 | | 5/1997 |

* cited by examiner

Fig. 1
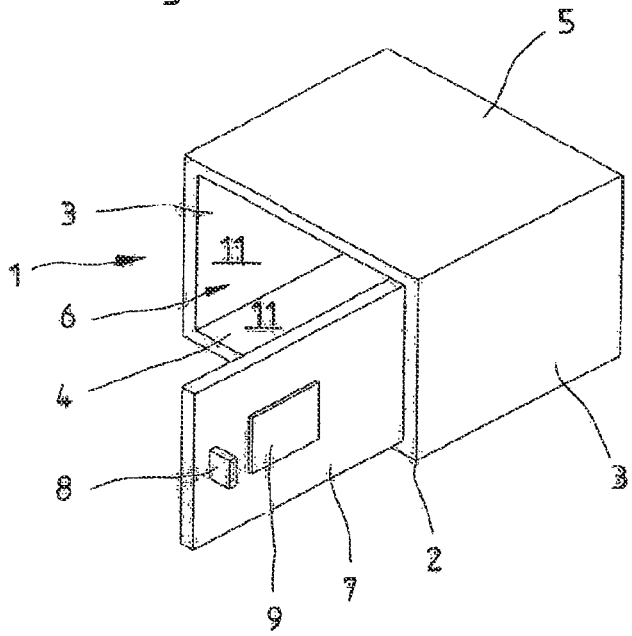
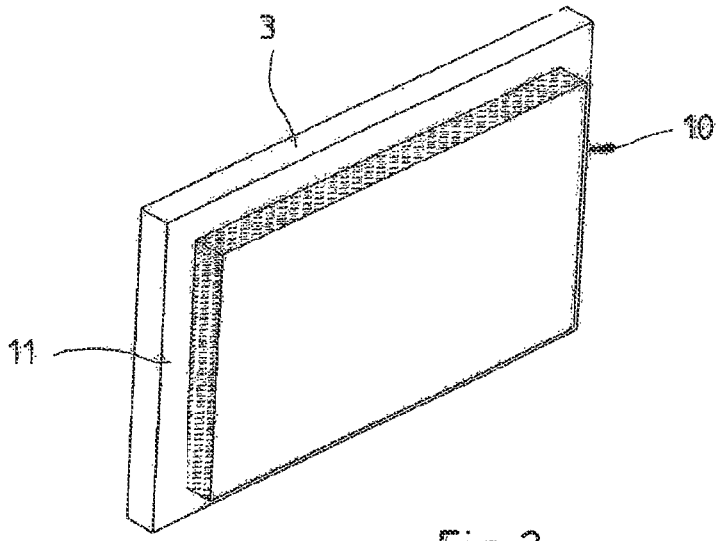
Fig. 2

CONTAINER FOR STORING OBJECTS, AND AN ABSORBER ELEMENT FOR SUCH A CONTAINER

The invention relates to a container for storing objects to be protected from unauthorized access, particularly an automatic teller, vault, safe or security cabinet, comprising a housing having a storage space, the housing having a rear wall, two mutually oppositely arranged side walls, a base and a top, wherein the base and the top are arranged mutually opposite and connect the side walls to each other, wherein the housing has at least one opening that can be locked using a door and/or flap. The invention further relates to an absorber element for such a container, the absorber element consisting of an insulation element made for instance from organic and/or inorganic fibers, preferably mineral fibers, bound with a binding agent and/or from extruded and/or expanded hard foam and/or porous concrete, pumice or a similar material having a high pore volume.

Containers for storing objects to be protected from unauthorized access are known in a great variety in prior art. The document DE 89 13 168 U1 may be mentioned as one example disclosing such a container in the form of a vault. This pre-known vault is comprised of a housing and a lockable door pivotally attached to the housing which together with the door defines a storage space intended for storing objects which are to be protected from unauthorized access. It turned out lately that introducing an explosive, e.g. a gas, in a required amount for instance through the keyhole or the sealing area between the door and the housing of such a container and thereafter igniting this material by an electric spark thus forcing the door open through the abruptly increasing volume of the material is a successful method of intrusion, and the tools required for this are rather simple. It is sufficient to have an explosive and an ignition device, for example an energy source in the form of a car battery, and a wire. To effectively protect containers from such unauthorized access by blasting, the document DE 20 2006 004 439 U1 describes the arrangement of an electric, electronic or mechanic spark generator inside the container, the spark generator producing ignition sparks in regular or irregular short intervals suitable for igniting combustible gases. However, the device pre-known from this document is suitable as an explosion protection only to a limited extent, since the explosive gas can be introduced if necessary at a high volume flow, so that the spark generator present in the container would already unintentionally cause a sufficient amount of gas to explode and thus open the container. To prevent such unintentional explosion, the spark generator is required to have a correspondingly high ignition frequency which is possible only with high energy density. But such a device isn't exactly suitable for containers use for private or semi-professional purposes. Incidentally, such a spark generator requires an energy source that is possibly not available and that must be accessible from outside for regular maintenance.

In view of the above prior art it is a problem of the present invention to improve a container of the above-described kind in such a way that it is sufficiently protected from unauthorized opening by explosion while simultaneously having a simple construction thus allowing a cost-efficient production of a corresponding container. The invention is further based on the problem of providing an absorber element offering sufficient protection against unauthorized opening by explosion while simultaneously allowing easy installation in existing containers.

In a container according to the invention the solution of this problem provides an absorber element being arranged inside the storage space. The solution of this problem further provides an absorber element that can be used in the storage space of a container.

Accordingly, the invention provides an absorber element inside the storage space of the container absorbing energy suddenly produced at the explosion of the explosive gas and converting this energy into strain energy and/or thermal energy in such a way that the excessive energy is insufficient for forcing the door off its locking or anchoring and thus gaining access to the objects of value inside the storage space.

A further feature of the invention provides that at least one inner surface of a side wall, base, top, rear wall and/or door oriented towards the storage space is at least partially covered with the absorber element, particularly made from a thermal and/or sound insulation element made for example from organic and/or inorganic and preferably mineral fibers bound with a binding agent. Surprisingly it turned out that the arrangement of such a thermal and/or sound insulation element made from organic and/or inorganic and preferably mineral fibers bound with a binding agent is particularly suited as an absorber element. In dependence of the volume of the storage space of the container one or more such absorber elements can be arranged in the region of the inner surfaces of the storage space. Insofar as several such absorber elements are used, the same can be installed for example with a correspondingly lower material thickness, so that these absorber elements do not considerably limit the useful volume of the container.

Preferably, the inner surface is covered with a glass or rock wool fiber board or matting. This construction of the absorber element from glass or rock wool fibers has the advantage that these materials exhibit a high flame resistance, so that the flame that it is possible produced at the ignition of an explosive gas will not cause the absorber element catching fire, thus exposing the matter inside the storage space of the container to an increased fire hazard.

A further feature of the invention provides that the absorber element is connected to the inner surface by adhesion. Here an adhesion over a part of the surface turned out as an advantage. Particularly suitable are adhesives which are non-combustible, thus limiting the fire hazard inside the storage space also in this respect.

To avoid adhesives that have to be additionally introduced into the storage space, an alternative construction of the invention provides for the absorber element being arranged in a holder disposed on the inner surface. This holder can consist for example of two L- or U-shaped profile elements that are fixed and preferably welded to an inner surface in the storage space with a distance from each other. These profile elements have free legs oriented towards each other. The absorber element can be supported in a positive or non-positive fashion behind these profile elements.

Additionally it can be provided that the holder includes a plate, preferably a plate in the form of a perforated metal sheet, covering the absorber element. This construction has the advantage that the absorber element is safely arranged behind the cover plate and is protected from damage. The preferred form of the cover plate as a perforated metal sheet has the advantage that the absorber element behind the perforated metal sheet develops higher efficiency in the case of a provoked explosion in the storage space, since the access of kinetic energy to the absorber element is simplified by the perforated surface.

A further feature of the invention provides that the absorber element is laminated with a cover that is perforated. In the case of an explosion inside the storage space this cover can at least partially destroyed and/or separated from the absorber element as a result of application of pressure, so that the absorber element develops its maximum effect in the case of an explosion. Moreover the cover can be provided in the form of a film, particularly from a non-combustible plastic material and/or metal.

Concerning the cover it is finally provided that in the case of an explosion the cover is at least partially separable from the absorber element.

Preferably, the absorber elements are arranged on inner surfaces of oppositely arranged surfaces of the side walls, base and top and/or rear wall of the door. This construction has the advantage that the kinetic energy induced during an explosion is ideally absorbed by two oppositely arranged absorber elements and converted corresponding to the above description. To still further improve the effect of the absorber elements during an explosion a further feature of the invention provides that the entire storage space is constructed with absorber elements in the region of its inner surfaces. In this construction it turned out as an advantage if at least the absorber element in the base region is covered with a rigid cover layer, particularly with a perforated metal sheet, thus forming an even supporting surface suitable for the arrangement of objects to be stored in the container. Here it is an advantage if the perforated surface is large, and it turned out that bores between 0.1 and 0.75 cm in the perforated metal sheet are particularly preferable.

A further feature of the invention provides that the fibers of the absorber element are oriented parallel to the inner surface. Such an absorber element exhibits high compressibility at right angles to the large surfaces of the absorber element, so that this compressibility can be utilized for the conversion of the kinetic energy of an explosion into strain energy. In this regard it turned out as an advantage if the absorber element is constructed from fibers having a bulk density of between 50 and 90 kg/m$^3$, particularly between 50 and 65 kg/m$^3$. Bulk densities higher than those mentioned result in an element which is as stiff as a board and which substantially lacks the preferred properties of compressibility.

A further feature of the invention provides that the absorber element has a large specific surface compared to its volume. Consequently, the absorber element has a large pore volume, so that the individual fibers, which for example have a diameter of only a few micrometers and a length of only a few millimeters, have a large surface which can consequently receive a high thermal energy. By using rock and/or glass fibers a material is selected which still is dimensionally stable at temperatures higher than 1000° C.

Apart from the above-described absorber elements from mineral fibers also absorber elements from metal can be used, which are particularly constructed from steel wool.

Finally, in the absorber element herein discussed it is an advantage if this absorber element has a low flow resistance, so that the kinetic energy occurring during an explosion can pass through the absorber element at a resistance which is as low as possible.

According to the invention the storage space can retrofitted with the absorber element.

The insulation element preferably consists of a thermal and/or sound insulation element from organic and/or inorganic fibers, preferably mineral fibers, bound with a binding agent. Depending on the volume of the storage space of the container one or more such insulation elements can be provided in modular fashion and arranged particularly in the region of the inner surfaces of the storage space. Inasmuch as several such insulation elements are combined to form an absorber element, the same can be installed for example with a lower material thickness, so that the absorber element does not considerably limit the useful volume of the container. The insulation elements constructed as modules can be preferably positively connected to each other.

Concerning the cover, it is finally provided that in the case of an explosion the cover is at least partially separable from the absorber element. Similarly, the absorber element can consist of a material which is crushed into small particles by the pressure energy during an explosion, so that the pressure energy is released through the crushing work.

Apart from the above-described absorber elements made from mineral fibers also absorber elements from metal, especially from steel wool, can be employed. Moreover, also other materials having a high pore volume such as porous concrete, pumice or the like can be used. In this case the properties of these materials can be utilized for dissipating energy during transformation.

Figure 4:
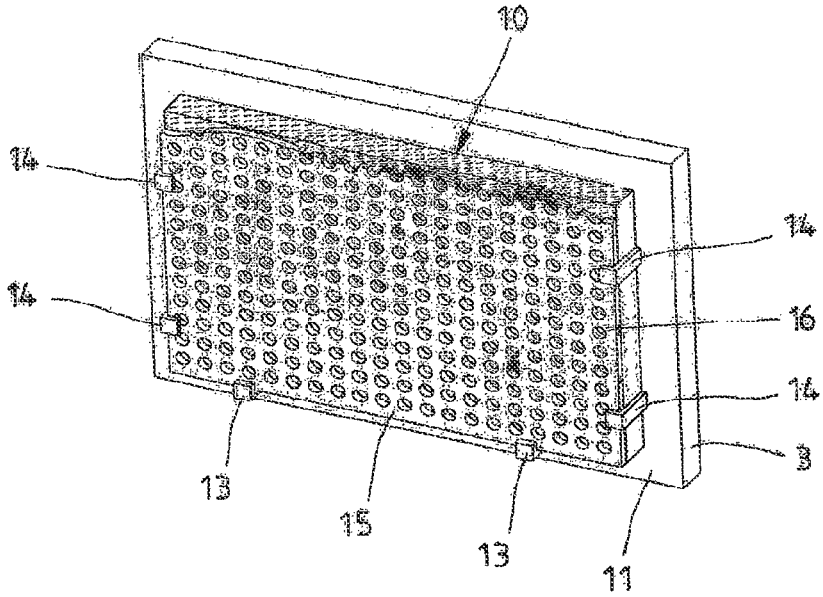
Figure 5:
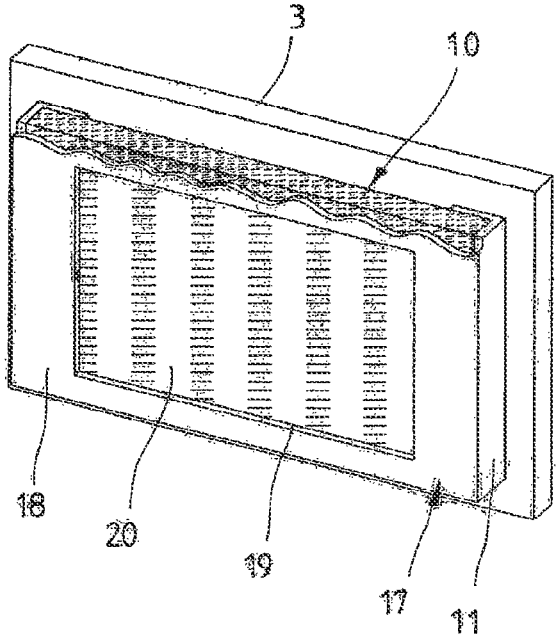
Figure 6:
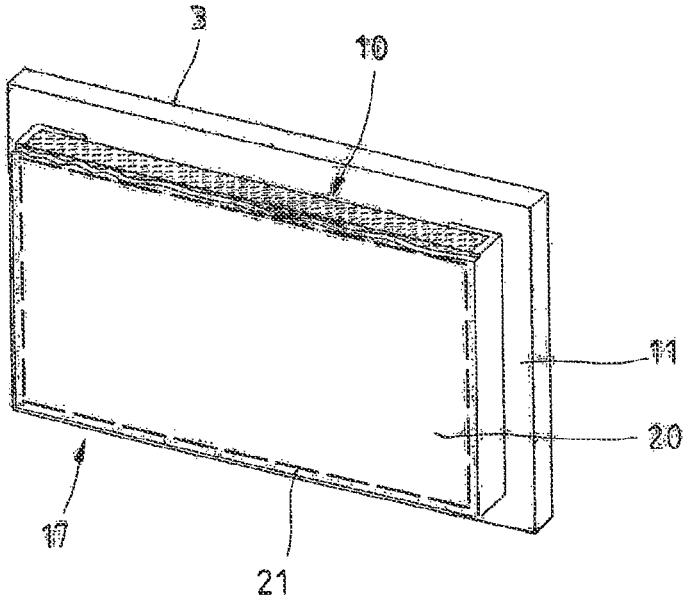
Figure 7:
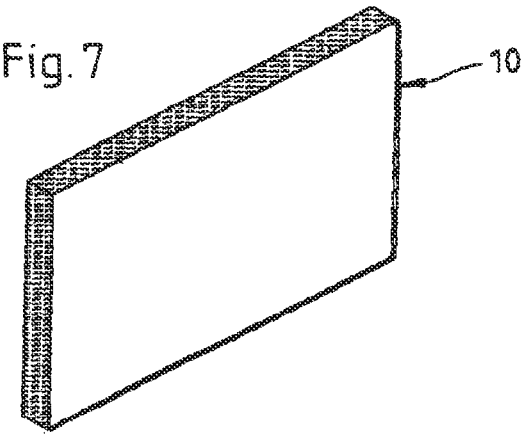
Figure 8:
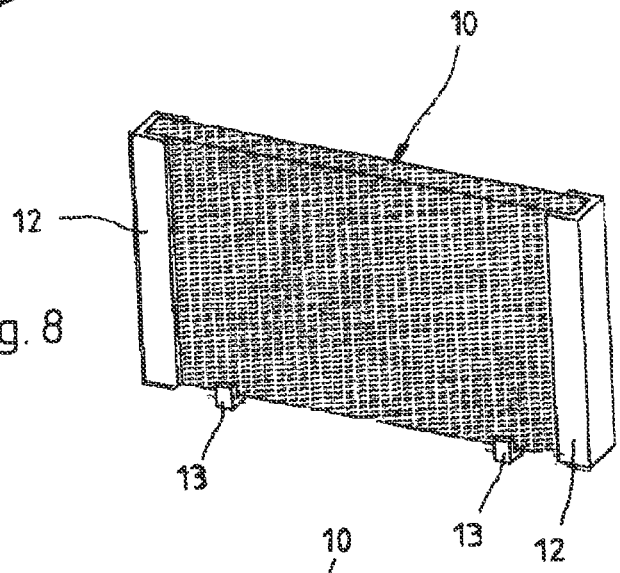
Figure 9:
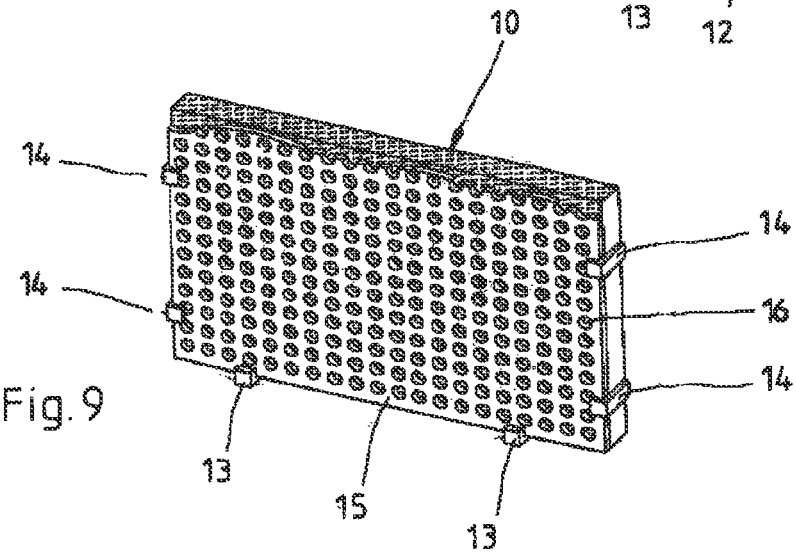
Figure 10:
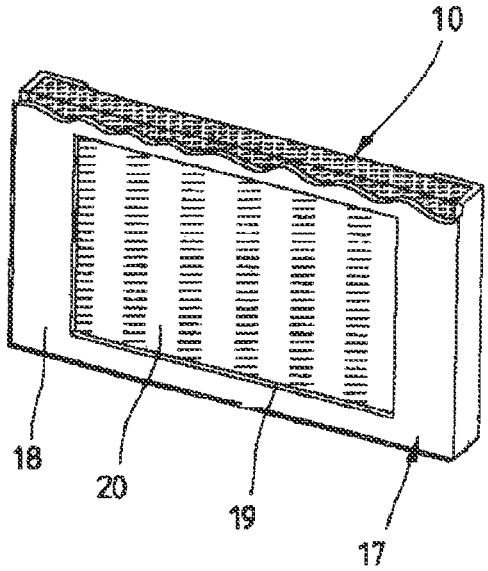
Figure 11:
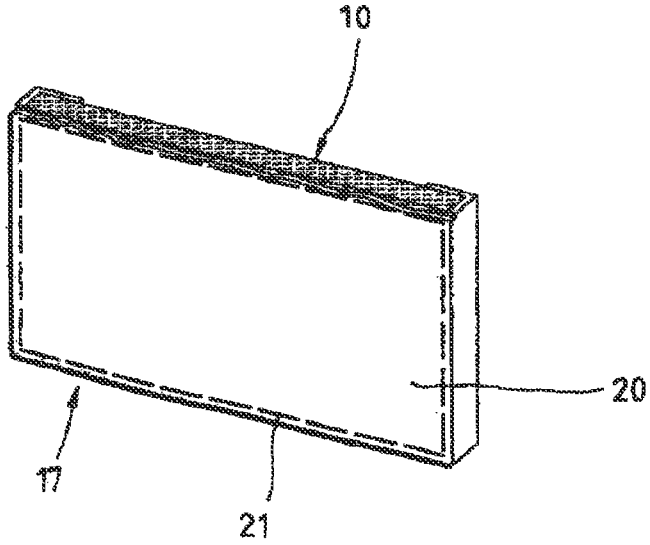

Further features and advantages of the invention will become apparent from the following description of the attached drawing showing preferred embodiments of a container according to the invention. In the drawing it is shown by:

FIG. 1 a perspective view of a container designed as a vault;

FIG. 2 a first embodiment of a rear wall of the container of FIG. 1 in a perspective view;

FIG. 3 a second embodiment of a wall of the container of FIG. 1 in a perspective view;

FIG. 4 a third embodiment of a wall of the container of FIG. 1 in a perspective view;

FIG. 5 a fourth embodiment of a wall of the container of FIG. 1 in a perspective view;

FIG. 6 a fifth embodiment of a wall of the container of FIG. 1 in a perspective view;

FIG. 7 an absorber element for the container of FIG. 1 in a perspective view;

FIG. 8 the absorber element of FIG. 7 including a first embodiment of a holder, in a perspective view;

FIG. 9 the absorber element of FIG. 7 including a plate and a second embodiment of a holder, in a perspective view;

FIG. 10 the absorber element of FIG. 7 including a third embodiment of a holder, in a perspective view;

FIG. 11 the absorber element of FIG. 7 including a fourth embodiment of a holder, in a perspective view.

FIG. 1 illustrates a container designed as a vault 1, in a perspective view. The vault 1 includes a housing 2 comprised of a rear wall not further shown, two side walls 3, a base 4 and a top 5. The side walls 3, base 4 and top 5 as well as the rear wall (not further shown) normally are a double-wall construction including a cavity between the walls which is filled for example with concrete. But it is also possible to construct the side walls 3, base 4 and top 5 as well as the rear wall which is not further shown form high-quality steel having a high material thickness, so that the vault 1 is burglarproof as required.

On the opposite side of the rear wall (not further shown) an opening 6 is provided that can be locked by a door 7. The door 7 is pivoted to a side wall 3 and terminates flush with the two side walls 3, the base 4 and top 5.

The door 7 is pivotally supported in the region of one side wall 3 and locks a storage space defined in the vault 1. The door 7 is provided with a usual locking mechanism (not further shown) that can be operated by a locking system 9, for example a keypad. The door 7 further comprises a handle 8 for manual operation of the door 7. The handle 8 may also have a function for operating the locking mechanism as soon as a code identical with a locking secret has been entered via the locking system 9.

Apart from the embodiment comprising a locking system 9 in the form of a keypad as illustrated in FIG. 1 it is also possible to operate the locking mechanism using one or two keys as usual.

The side walls 3, base 4 and bottom 5 and also the rear wall (not further shown) of the vault 1 represent walls that may be configured corresponding to the FIGS. 2 to 6 showing one exemplary embodiment of a side wall 3. In the same way also the door 7 may be regarded as a wall of the vault 1 and thus may be constructed corresponding to the embodiments according to the FIGS. 2 to 6.

The FIGS. 2 to 6 show five examples of a side wall 3 each including an absorber element 10. The absorber element 10 serves to absorb a high kinetic energy such as the kinetic energy caused by the ignition of an explosive gas introduced into the storage space. This kinetic energy is converted by the absorber element 10 into strain energy. The heat energy produced at the ignition of the explosive gas is absorbed by the absorber element 10.

The construction of the absorber element 10 will be described in more detail in the following.

FIG. 2 shows a first embodiment of a side wall 3 having an inner surface 11 to which the absorber element 11 is adhered. For bonding the absorber element 10 to the inner surface 11, a heat-resistant adhesive is provided which is applied to a part of the inner surface 11 and is thus adhered also to a partial surface of the absorber element 10.

The absorber element 10 consists of a thermal and/or sound insulation element made from mineral fibers, for example glass or rock wool fibers, bound with binding agents. The absorber element 10 has a fiber orientation parallel to the inner surface 11 of the side wall 3. Moreover, the absorber element 10 has a bulk density of 50 kg/m$^3$, so that the absorber element 10 exhibits high elasticity serving to absorb high pressure energy deforming the absorber element 10. As a binding agent in the absorber element a phenolic resin binder is provided contained in the absorber element 10 at a volume of 2 to 4 percent by weight. The small moiety of this binder increases the elasticity of the absorber element 10 and additionally serves to positively influence the flame resistance of the absorber element 10. With a binder moiety being that small, it has to be assumed that the individual mineral fibers in the region of their crossing points become bound by the binding agent in droplet form, so that the surfaces of the mineral fibers are substantially free from binding agents, thus serving to absorb high thermal energies.

A second embodiment of a side wall 3 is shown in FIG. 3. In this embodiment two mutually spaced profiles 12 having a U-shaped cross section are mutually aligned on the inner surface 11 on the side wall 3 in such a manner that their free legs are oriented so as to extend towards each other. The profiles 12 serve to receive the absorber element 10 having a plate-like design. The profiles 12 extend vertically in the usual arrangement of the vault 1 as illustrated in FIG. 1. In the lower part of the side wall 3 two mutually spaced hooks 13 are fixed to the inner surface 11 of the side wall 3 and serve as a support for the absorber element 10. The profiles 12 and the hooks 13 can be connected to the side wall 3 by welding for example.

Compared to the embodiment according to FIG. 2, the embodiment according to FIG. 3 has the advantage that the absorber element 10 in addition to a high elasticity and thus compressibility in the direction of the surface normal of the inner surface 11 includes further degrees of freedom serving to absorb energies produced during an explosion in the storage space. For instance, the absorber element 10 can be at least moved in a direction parallel to the inner surface 11.

A further advantage exists in that any bonding is unnecessary, so that any deterioration of the connection between the absorber element 10 and the inner surface 11 due to ageing can be excluded. The absorber element 10 can also be easily exchanged if it has lost its effect due to ageing or has become damaged by normal use of the vault 1.

FIG. 4 shows a third embodiment of a side wall 3 including an absorber element 10. Differently from the embodiment according to FIG. 3 it can be seen that the profiles 12 illustrated in FIG. 3 are replaced by L-shaped hooks 14. This embodiment has the advantage that the reaction surface of the absorber element 10 is maintained as completely as possible and is not covered by legs of the profiles.

Further, the embodiment according to FIG. 4 is different from the embodiment according to FIG. 3 in that the absorber element 10 is arranged between the inner surface 11 of the side wall 3 and a cover plate 15 which is designed as a perforated metal sheet. The cover plate 15 has a plurality of holes 16, the entire area of the holes being larger than the remaining area of the plate 15.

FIG. 5 shows a further embodiment of the side wall 3 including the absorber element 10. In this embodiment the absorber element 10 is arranged inside a pan 17 connected and particularly welded to the inner surface 11 of the side wall 3.

The pan 17 includes a front plate 18 having an opening 19 in the central area, said opening 19 being closed with a cover 20. The cover 20 consists of a film which is made for example from an inflammable plastic material and/or metal and which is destroyable and/or separable from the pan 17 in the case of an explosion in the storage space of the vault 1, so that the absorber element 10 can become fully effective together with the cover 20 after destruction in the case of an explosion. For this purpose the cover 20 may include for example predetermined breaking points which are not further shown in FIG. 5.

The cover arranged in the opening 19 of the pan 17 can also be provided in the form of a film that melts if the temperature is increased.

FIG. 6 finally shows a further embodiment of the side wall 3 including the absorber element that is supported in a pan 17 including as a cover 20 an element that can be blasted out along a predetermined breaking point 21 upon an increase in pressure.

Besides the above-described embodiments of the invention also other embodiments are conceivable. What is only important here is that the absorber element 10 absorbs the pressure and heat energy in the case of an explosion in the storage space, so that it is not possible for the door 7 being blasted out of the housing 2. For example, the absorber element 10 can also be made from metal, particularly steel wool. It turned out to be an advantage if the absorber element 10 exhibits a low flow resistance and additionally a large specific surface.

In addition to the above-described embodiments it also possible to arrange at least one and preferably more absorber elements in the cavities between a double wall structure, the sections of the inner wall being movable with respect to the outer wall thus enabling the absorber elements to be accessed in the case of an explosion in the inner space of the container. Such a section can be displaced through an explosion for example in the direction of the outer wall against a resilient element, absorber elements between the two walls being accessible above and below this element or laterally thereof. Elastic rubber elements or also metal springs already absorbing a part of the energy released during an explosion can be provided as spring elements.

FIG. 7 shows an absorber element 10. The absorber element 10 serves to receive high kinetic energy that is produced for example by the ignition of an explosive gas introduced into the storage space. The absorber element 10 converts this kinetic energy into strain energy. The heat energy produced at the ignition of the explosive gas is absorbed by the absorber element 10.

The construction of the absorber element 10 will be described in more detail in the following.

The absorber element 10 in the embodiment shown in FIG. 2 can be adhered to an inner surface of the housing 2. For bonding the absorber element 10 to the inner surface a heat-resistant adhesive is provided which is applied to a part of the inner surface and thus adhered to a part of the surface of the absorber element 10.

The absorber element 10 consists for example of an insulation element made from mineral fibers, for example glass or rock wool fibers, bound with a binding agent and has the fibers running parallel to the inner surface of the side wall 3. Moreover, the absorber element 10 has a bulk density of 50 $kg/m^3$, so that the absorber element 10 exhibits high elasticity serving to absorb high pressure energy by which the absorber element 10 is deformed. As a binding agent in the absorber element 10 a phenolic resin binder is provided at a volume of approximately 2 to 4 percent by weight within the absorber element 10. The small moiety of this binder increases the elasticity of the absorber element 10 and additionally serves to positively influence the flame resistance of the absorber element 10. With such a small moiety of binders it can be assumed that the individual mineral fibers in the region of their crossing points become bound by the binder in a droplet form, so that the surfaces of the mineral fibers are substantially free from binding agents and thus serve to absorb high thermal energies. Alternatively, the absorber element 10 can be arranged in holders which are shown in various embodiments in the FIGS. 8 to 11.

A first embodiment of a holder is shown in FIG. 8. This embodiment consists of two mutually spaced profiles 12 having a U-shaped cross section and aligned with respect to each other in such a manner that their free legs are oriented such as to extend towards each other. The profiles 12 serve to receive the absorber element 10 which is formed in a plate-like fashion. If arranged in the usual fashion inside the vault 1, the profiles 12 can be oriented so as to extend vertically, as shown in FIG. 1. Further the holder includes in the lower part of the absorber element 10 two mutually spaced hooks 13 adapted to be fixed to the inner surface of the side wall 3 and serving as a support for the absorber element 10. The profiles 12 and hooks 13 can be fixed to the side wall 3 for example by welding or bonding.

The use of an absorber element 10 in a holder has the advantage that in addition to a high elasticity and thus compressibility the absorber element 10 also has further degrees of freedom in the direction of the surface normal of the inner surface which serve to absorb energies produced at an explosion in the storage space. Thus the absorber element 10 can be moved at least in a direction parallel to the inner surface.

Another advantage is that any tight bonding of the absorber element 10 is not required, so that any deterioration caused by ageing of the connection between the absorber element 10 and the inner surface can be excluded. Further, the absorber element 10 can be easily exchanged if its effect has deteriorated due to ageing or if it has become damaged by normal use of the vault 1.

FIG. 9 shows a second embodiment of a holder with an absorber element 10. Differently from the embodiment shown in FIG. 8 it can be seen that the profiles 12 shown in FIG. 8 are replaced by L-shaped hooks 14. This embodiment has the advantage that the reaction surface of the absorber element 10 is maintained as completely as possible and is not covered by the legs of the profiles.

The embodiment according to FIG. 9 is different from the embodiment according to FIG. 8 also in that the absorber element 10 is arranged between the inner surface 11 of the side wall 3 and a cover plate 15 which is formed as a perforated metal sheet. The cover plate 15 includes a plurality of holes 16, the entire area thereof being larger than the remaining area of the plate 15.

FIG. 10 shows a further embodiment of a holder with the absorber element 10. In this embodiment the absorber element 10 is arranged in a pan 17 that can be connected to the side wall 3, particularly by welding or bonding.

The pan 17 includes a front plate 18 having an opening 19 in the central area which is closed with a cover 20. The cover 20 consists of a film, for example from a non-combustible plastic material and/or metal, which is destroyable and/or separable from the pan 17 in the case of an explosion in the storage space of the vault 1, so that the absorber element 10 together with the cover 20 can become fully effective after destruction in the case of an explosion. For this purpose the cover 20 can be provided for example with predetermined breaking points which are not further shown in FIG. 10.

The cover 20 arranged in the opening 19 of the pan 17 can also be provided in the form of a film melting upon an increase in temperature.

FIG. 11 finally shows a further embodiment of the holder with the absorber element 10 that is supported in a pan 17, wherein the pan 17 includes as a cover 20 an element that can be blasted out along predetermined breaking points 21 if the pressure increases.

Besides the above-described embodiments of the invention also other embodiments are conceivable. The only important point here is that the absorber element 10 absorbs the pressure or heat energy in the case of an explosion occurring in the storage space thus preventing the door 7 from jumping out of the housing 2. For example, the absorber element 10 can be also made from metal, particularly steel wool. It turned out to be an advantage if the absorber element 10 exhibits a low flow resistance and moreover a large specific surface. In addition to fibrous elements also granulates, spherical and/or stalk-like elements can be used for forming the absorber element.

LIST OF REFERENCE NUMBERS

1 vault
2 housing
3 side wall
4 base
5 top
6 opening
7 door
8 handle
9 locking system
10 absorber element
12 profile
13 hook
14 hook
15 plate
16 hole
17 pan
18 front plate
19 opening
20 cover
21 predetermined breaking point

The invention claimed is:

1. A storage container in which objects to be protected from unauthorized access are stored, namely automatic teller machine, vault, safe or security cabinet, said container comprising a housing including a storage space and including a rear wall, two side walls disposed opposite each other, a base and a top, so that the container provides the required safety against burglary, wherein the base and the top are disposed opposite each other and connect the side walls to each other, said housing having at least one opening that can be locked using at least one door and/or flap, and an absorber element disposed inside the storage space, the absorber element having a high pore volume and absorbing energy suddenly produced at the explosion of an explosive gas; and wherein the absorber element is made from fibers having a bulk density of between 5 and 90 k/m$^3$, particularly between 50 and 65 kg/m$^3$.

2. A container according to claim 1, wherein at least one inner surface of a side wall, the base, top, rear wall and/or door oriented towards the storage space is at least partially covered with the absorber element made particularly from a heat and/or sound insulation element.

3. A container according to claim 1, wherein the inner surface is covered with a plate or matting from glass or rock wool fibers.

4. A container according to claim 1, wherein the absorber element is connected to the inner surface through adhesion.

5. A container according to claim 4, wherein the adhesion is provided on a part of the area.

6. A container according to claim 1, wherein the absorber element is disposed in a holder arranged on the inner surface.

7. A container according to claim 5, wherein the holder includes a plate covering the absorber element, said plate being preferably constructed as a perforated metal sheet.

8. A container according to claim 1, wherein the absorber element is laminated with a cover which is perforated.

9. A container according to claim 1, wherein absorber elements are arranged on inner surfaces of oppositely arranged surfaces of the side walls, the base and top and/or rear wall and door.

10. A container according to claim 1, wherein the entire storage space is provided with absorber elements in the region of its inner surfaces.

11. A container according to claim 3, wherein the fibers of the absorber element are oriented parallel to the inner surface.

12. A container according to claim 1, wherein the absorber element is formed with a cover which is at least partly destroyable by the influence of pressure and/or separable from the absorber element in the case of an explosion inside the storage space.

13. A container according to claim 12, wherein the cover is made from a film, particularly from non-combustible plastic material and/or metal.

14. A container according to claim 12, wherein the cover is adapted to be separable at least partially from the absorber element in the case of an explosion.

15. A container according to claim 1, wherein the absorber element has a large specific surface in relation to its volume.

16. A container according to claim 1, wherein the absorber element is constructed from metal, particularly steel wool.

17. A container according to claim 1, wherein the absorber element exhibits a low flow resistance.

18. An absorber element for a container for storing objects to be protected from unauthorized access, particularly for automatic telling machines, a vault or a security cabinet, said absorber element comprising an insulation element made from organic and/or inorganic, preferably mineral fibers, preferably bound with binding agents, and/or extruded and/or expanded foam, particularly hard or soft foam, preferably open-pored, and/or porous concrete, pumice or similar materials having a high pore volume, said absorber element being adapted for the arrangement in the region of a storage space, particularly on an inner surface oriented towards the storage space, for example on a rear wall and/or side wall oriented towards the storage space, a base oriented towards the storage space, a top oriented towards the storage space, a rear wall oriented towards the storage space and/or a door oriented towards the storage space and/or a flap oriented towards the storage space, and having a high pore volume absorbing energy suddenly produced at the explosion of an explosive gas; and wherein the insulation element is made from fibers having a bulk density of between 5 and 90 kg/m$^3$, particularly between 50 and 65 kg/m$^3$.

19. An absorber element according to claim 18, wherein the insulation element is formed from a plate or a matting made of glass or rock wool fibers.

20. An absorber element according to claim 18, wherein the insulation element is connectible to the inner surface by adhesion.

21. An absorber element according to claim 20, wherein the adhesion is formed on a part of the area.

22. An absorber element according to claim 18, including a holder adapted to be fixed to the inner surface.

23. An absorber element according to claim 22, wherein the holder includes a plate which is preferably designed as a perforated metal sheet.

24. An absorber element according to claim 18, including a lamination which is perforated.

25. Absorber element according to claim 19, wherein the fibers of the insulation element are oriented parallel to the inner surface.

26. An absorber element according to claim 18, including a cover which is at least partly destroyable by the influence of pressure and/or separable from the insulation element in the case of an explosion inside the storage space.

27. An absorber element according to claim 26, wherein the cover is made from a film, particularly from non-combustible plastic material and/or metal.

28. An absorber element according to claim 18, including a surface which is large in relation to the volume.

29. An absorber element according to claim 18, including an insulation element made from metal, particularly from steel wool.

30. An absorber element according to claim 18, wherein the insulation element exhibits a low flow resistance.

31. An absorber element according to claim 18, wherein the insulation element is composed from individual modules.

32. An absorber element according to claim 23, wherein a number of modules are assembled together in dependence of the volume of the storage space.

33. An absorber element according to claim 32, wherein the module are connectible to each other especially in a form-fit fashion.

34. An absorber element according to claim 18, wherein the modules consist of holders and insulation elements in the holders, said holders having correspondingly formed connection elements.

* * * * *